US010437198B2

(12) United States Patent
La China et al.

(10) Patent No.: US 10,437,198 B2
(45) Date of Patent: Oct. 8, 2019

(54) TIMEPIECE CALENDAR SYSTEM

(71) Applicant: ROLEX SA, Geneva (CH)

(72) Inventors: Marco La China, Vernier (CH); Vincent Lemosquet, Bons-en-Chablais (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/360,867

(22) Filed: Nov. 23, 2016

(65) Prior Publication Data

US 2017/0153604 A1 Jun. 1, 2017

(30) Foreign Application Priority Data

Nov. 26, 2015 (EP) ..... 15196611

(51) Int. Cl.
*G04B 19/253* (2006.01)
*G04B 19/247* (2006.01)

(52) U.S. Cl.
CPC ..... *G04B 19/247* (2013.01); *G04B 19/2536* (2013.01)

(58) Field of Classification Search
CPC .. G04B 19/247; G04B 19/2536; G04B 19/24; G04B 19/25
USPC ..... 368/38
See application file for complete search history.

(56) References Cited

U.S. PATENT DOCUMENTS 2,764,828 A 10/1956 Wolaver
3,518,825 A 7/1970 Nissen
4,048,795 A * 9/1977 Risi ..... G04B 19/247 368/38
4,171,610 A 10/1979 Gilomen
4,228,644 A 10/1980 Watanabe et al.
5,289,437 A 2/1994 Leuenberger et al.
5,432,759 A 7/1995 Vaucher
6,108,278 A 8/2000 Rochat
6,744,696 B2 * 6/2004 Vernay ..... G04B 19/2536 368/28
7,366,058 B2 4/2008 Marki et al.
7,835,229 B2 * 11/2010 Chaignat ..... G04B 19/25366 368/28
8,040,759 B2 * 10/2011 Chaignat ..... G04B 19/247 368/233

(Continued)

FOREIGN PATENT DOCUMENTS

CH 681 673 B5 11/1993
CH 685 585 B5 2/1996

(Continued)

OTHER PUBLICATIONS

Index—fhs.swiss/berner—Oct. 11, 2012.*

(Continued)

*Primary Examiner* — Sean P Kayes
(74) *Attorney, Agent, or Firm* — Westerman, Hattori, Daniels & Adrian, LLP

(57) ABSTRACT

A timepiece calendar system (100) including: —a date mobile (1); —a first device (3) for indexing the position of the date mobile; —a second device (4) for indexing the position of the date mobile; —an element (70, 3*b*, 4*b*, 40) for activating and deactivating at least one of the first and second indexing devices, the indexing of the date mobile by one or the other of the first and second indexing devices being mutually exclusive.

25 Claims, 11 Drawing Sheets

(56) References Cited

U.S. PATENT DOCUMENTS

Figure 1:
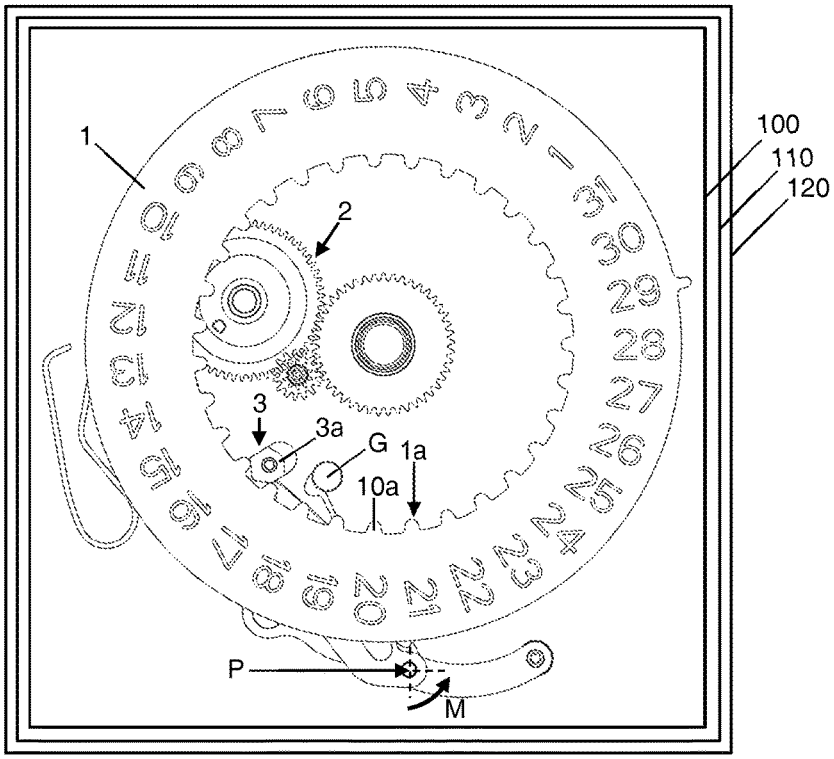

| | | | | |
|---|---|---|---|---|
| 8,503,267 | B2 | 8/2013 | Philippine | |
| 8,509,035 | B2 | 8/2013 | Philippine | |
| 8,605,553 | B2 | 12/2013 | Chaignat et al. | |
| 8,842,500 | B2 * | 9/2014 | Schmidt | G04B 19/2536 368/37 |
| 9,367,039 | B2 * | 6/2016 | Carreno | G04B 1/00 |
| 9,612,577 | B2 | 4/2017 | Lecher | |
| 2003/0151981 | A1 | 8/2003 | Vemay et al. | |
| 2005/0078558 | A1 | 4/2005 | Dalloz | |
| 2006/0098535 | A1 | 5/2006 | Marki et al. | |
| 2006/0120219 | A1 | 6/2006 | Ruefenacht | |
| 2006/0221773 | A1 | 10/2006 | Kuepfer et al. | |
| 2008/0094941 | A1 | 4/2008 | Pellaton | |
| 2009/0003139 | A1 | 1/2009 | Kuepfer et al. | |
| 2010/0103780 | A1 | 4/2010 | Chaignat | |
| 2012/0106301 | A1 | 5/2012 | Philippine | |
| 2012/0106302 | A1 | 5/2012 | Philippine | |
| 2012/0127835 | A1 | 5/2012 | Dubugnon et al. | |
| 2012/0213038 | A1 * | 8/2012 | Schmidt | G04B 19/2536 368/37 |
| 2013/0336096 | A1 | 12/2013 | Grossenbacher et al. | |
| 2015/0286189 | A1 | 10/2015 | Gruenig et al. | |

FOREIGN PATENT DOCUMENTS

| | | | |
|---|---|---|---|
| CH | 697 673 | B1 | 1/2009 |
| CH | 699 794 | A2 | 4/2010 |
| CH | 704 082 | A2 | 5/2012 |
| CH | 704 505 | A2 | 8/2012 |
| CH | 706 799 | A2 | 2/2014 |
| EP | 0 634 711 | A1 | 1/1995 |
| EP | 0 987 609 | A1 | 3/2000 |
| EP | 1 335 253 | A1 | 8/2003 |
| EP | 1 524 564 | A1 | 4/2005 |
| EP | 1 666 991 | A1 | 6/2006 |
| EP | 1 962 152 | A1 | 8/2008 |
| EP | 2 180 383 | A1 | 4/2010 |
| EP | 2 428 856 | A1 | 3/2012 |
| EP | 2 428 856 | B1 | 1/2014 |
| FR | 2 355 321 | A1 | 1/1978 |
| WO | 2004/066039 | A1 | 8/2004 |
| WO | 2004/114027 | A2 | 12/2004 |
| WO | 2015/062839 | A2 | 5/2015 |

OTHER PUBLICATIONS

Index assembly—fhs.swiss/berner—Oct. 11, 2012.*

Jumper—fhs.swiss/berner—Oct. 11, 2012.*

European Search Report and Written Opinion dated May 11, 2016 issued in corresponding application No. EP15196611; w/ English partial translation and partial machine translation (12 pages).

European Search Report and Written Opinion dated May 24, 2016 issued in application No. EP15196614 corresponding to co-pending U.S. Appl. No. 15/360,855; w/ English partial translation and partial machine translation (12 pages) (EP0987609 and EP1666991 cited in the ESR and Specification, and EP2428856 and CH681673 cited in the Specification of the co-pending application are not listed in this IDS form since they are already listed in an IDS form filed concurrently).

Office Action dated Dec. 29, 2017 in co-pending U.S. Appl. No. 15/360,860; with PTO892; without returned SB08 (10 pages) (Reference H, U.S. Pat. No. 2,764,828 is not listed in this IDS since it was already listed in the IDS filed Nov. 20, 2017).

Office Action dated Nov. 17, 2017 in co-pending U.S. Appl. No. 15/360,855; with PTO892; without returned SB08 (14 pages).

European Search Report and Written Opinion dated May 12, 2016 issued in application No. EP15196613 corresponding to co-pending U.S. Appl. No. 15/360,860; w/ English partial translation and partial machine translation (10 pages) (EP0987609 cited in the ESR and Specification, and EP2428856A1 corresponding to EP2428856B1 cited in the Specification of the co-pending application are not listed in this IDS form since they are already listed in an IDS form filed concurrently).

Notice of Allowance dated May 10, 2018 in co-pending U.S. Appl. No. 15/360,860; without returned SB08 (6 pages).

Corrected Notice of Allowability dated Aug. 8, 2018 in co-pending U.S. Appl. No. 15/360,860; without returned SB08 (4 pages).

"Stopwork", in Illustrated Professional Dictionary of Horology, Federation of the Swiss Watch Industry, 1961-2018, fhs.swiss/berner/?l=en, retrieved Jul. 31, 2018 (1 page; in English; ref. U in Corrected Notice of Allowability dated Aug. 8, 2018 in co-pending U.S. Appl. No. 15/360,860).

"Cross", in Illustrated Professional Dictionary of Horology, Federation of the Swiss Watch Industry, 1961-2018, fhs.swiss/berner/?l=en, retrieved Jul. 31, 2018 (1 page; in English; ref. V in Corrected Notice of Allowability dated Aug. 8, 2018 in co-pending U.S. Appl. No. 15/360,860).

Office Action dated Jul. 16, 2018 in co-pending U.S. Appl. No. 15/360,855; without returned SB08 (20 pages).

Notice of Allowance dated Feb. 21, 2019 in co-pending U.S. Appl. No. 15/360,855; without returned SB08 (8 pages).

* cited by examiner

TIMEPIECE CALENDAR SYSTEM

This application claims priority of European patent application No. EP15196611.6 filed Nov. 26, 2015, the content of which is hereby incorporated by reference herein in its entirety.

The invention concerns a timepiece calendar system, in particular an annual or perpetual timepiece calendar system. It also concerns a timepiece movement including such a system. It further concerns a timepiece, notably a wristwatch, including such a system or such a movement. It finally concerns a method of operating such a timepiece calendar system, such a movement or such a timepiece.

There is known from the patent application EP0987609 an annual calendar mechanism including two kinematic systems for driving the date disk. A first calendar drive mobile enables a first jump of the date disk every day. A second calendar drive mobile, called the correction mobile, enables an additional jump of the date disk at the end of a month comprising thirty days. The latter disk is pivoted on a lever the angular position of which is controlled by a month cam and return spring. A construction of this kind requires a large number of components, notably springs and levers, and consumes a great deal of energy. Moreover, because of the sequencing of the operation of such a mechanism, it is very difficult to achieve a good quality of the instantaneous date jump of the calendar at the end of a short month.

There is known from the patent application EP1335253 an annual calendar mechanism employing a lever for driving the date disk which, at the end of each month comprising thirty days, operates in conjunction with a conventional calendar drive mobile. A roller mounted on the drive lever is adapted to cooperate at all times with a cam at the outside periphery of the date disk.

Throughout the month, the lever accumulates the energy necessary for an additional date jump by arming a spring via a profile of the cam. The profile terminates in a steep slope so that the lever and its roller can advance the date disk by an additional step because of the effect of the force produced by the spring. Here the spring is sized so that it can overcome the torque retaining the date disk that is provided by a conventional indexing jumper, which is less than the optimum in terms of energy consumption. Moreover, because of the effect of the spring, the roller of the lever bears against the date disk at all times, and so an ancillary device for adjusting the force of the spring is recommended to enable easy adjustment of the calendar.

There is known from the application CH706799 an annual calendar mechanism including a drive lever that has the particular feature of acting on the date disk in a localized manner. At the end of each month, the number of jumps of the date disk is a function of the angular travel that the lever is liable to effect. To this end, the lever is controlled both by a calendar cam that is adapted to store the energy required for driving the date disk and by an annual cam adapted to define the amplitude of the angular travel of the lever. The spring for actuating the drive lever is sized so that it can overcome the torque retaining the date disk over two angular steps of the date disk, which is not favorable in terms of energy. Moreover, a disengagement mechanism between the date disk and the lever driving the date disk is required to enable adjustment of the calendar when the lever is interacting with the toothset of the date disk.

There is known from the application EP1962152 a device to assist retaining a date disk in position. The latter application discloses a locking member which, when not driving the date disk, acts on a date disk indexing jumper so as to prevent all risk of a double date jump.

There is finally known from the application EP2180383 a device to assist retaining a date disk in position. The latter application discloses a member for locking an indexing jumper of a date disk that can be actuated by an ancillary correction mechanism to minimize the resisting torque when adjusting the date.

Thus the known prior art annual calendars are traditionally equipped with one or two calendar drive mobiles that are adapted to cooperate with a month auxiliary wheel or cam. This element controls the double date jump mechanism at the end of each short month, possibly by way of additional levers and springs. A construction of this kind can induce a particularly delicate sequence of operations. The double date jump at the end of months comprising thirty days may be problematic because of the sequencing of the operation of two distinct kinematic systems driving the date disk and also because of the additional energy that such a jumper requires.

The object of the invention is to provide a timepiece calendar system making it possible to eliminate the disadvantages referred to above and to improve the known prior art timepiece calendar systems. In particular, the invention notably proposes a reliable annual timepiece calendar system the energy consumption of which is minimized.

A timepiece calendar system according to the invention is defined as follows:

1. A timepiece calendar system comprising:
   - a date mobile;
   - a first device for indexing the position of the date mobile;
   - a second device for indexing the position of the date mobile;
   - an element for activating and deactivating at least one of the first and second indexing devices, the indexing of the date mobile by one or the other of the first and second indexing devices being mutually exclusive.

Various embodiments of the system are defined as follows:

2. The system as in point 1 above, wherein the activation and deactivation element comprises:
   - a first device for deactivating the first indexing device; and
   - a second device for activating the second indexing device, the first deactivation device being such that the first indexing device is deactivated and the second activating device being such that the second indexing device is activated when the date mobile is driven on passing from a short month to the next month.
3. The system as in the preceding point, wherein the first deactivation device is arranged such that the first indexing device is deactivated and the second activation device is arranged such that the second indexing device is activated during a day, or even two days, or even three days, preceding the passage from a short month to the next month and/or the first deactivation device is arranged such that the first indexing device is activated and the second activation device is arranged such that the second indexing device is deactivated by default, i.e. the rest of the time.
4. The system as in either one of points 2 and 3 above, wherein the system includes an element for driving the date mobile, the first indexing device being such that the date mobile is moved one step on each action of the drive element and the second indexing device being such that the date mobile is moved by two steps on each action of the drive element occurring at the end of the thirtieth day of a short month.

5. The system as in any one of points 2 to 4 above, wherein the first device for deactivating the first indexing device includes a control cam and/or the second device for activating the second indexing device includes a control cam.
6. The system as in the preceding point, wherein the second indexing device is adapted to cooperate, notably to cooperate by contact, with the control cam, notably via a roller on a lever.
7. The system as in any one of points 2 to 6 above, wherein the first device for deactivating the first indexing device includes a first banking on the first indexing device cooperating with a second banking on the second indexing device so as to move the first indexing device away from its position cooperating with the date mobile and to subject the second indexing device to the torque of the first return spring of the first indexing device when the second indexing device is cooperating with the date mobile.
8. The system as in any one of the preceding points, wherein the first indexing device includes a jumper, in particular a jumper head, and a first return spring.
9. The system as in the preceding point, wherein the jumper, notably the head of the jumper, is adapted to cooperate with a first toothset of the date mobile because of the effect of the first return spring.
10. The system as in any one of the preceding points, wherein the second indexing device includes a lever having a head, notably a roller, and a second return spring.
11. The system as in the preceding point, wherein the lever, notably the head, is adapted to cooperate with a second toothset of the date mobile because of the effect of the first return spring and/or the second return spring.
12. The system as in the preceding point, wherein the second toothset has a cam surface enabling the roller to drive the date mobile over two steps of the date mobile.
13. The system as in any one of the preceding points, wherein the first and second indexing devices are rotatable about the same axis and the return torque on the second indexing device about the axis is less than, in particular five times less than, or even ten times less than, the return torque of the second indexing device about the axis.
14. The system as in any one of the preceding points, wherein the system is of the instantaneous jump type.

A movement according to the invention is defined as follows:

15. A timepiece movement including a system as in any one of points 1 to 14 above.

A timepiece according to the invention is defined as follows:

16. A timepiece, in particular a wristwatch, including a system as in any one of points 1 to 14 above or a movement as in the preceding point.

An operating method according to the invention is defined as follows:

17. A method of operating a timepiece calendar system comprising:
    a date mobile;
    a first device for indexing the position of the date mobile;
    the second device for indexing the position of the date mobile;
    an element for activating and deactivating at least one of the first and second indexing devices,
    the method including deactivating the first indexing device and activating the second indexing device for the passage from dates of a short month to the next month.

An embodiment of the method is defined as follows:

18. The method of point 17 above, wherein the method includes keeping the first indexing device active and keeping the second indexing device inactive for the passage from dates of a long month to the next month.

FIGS. 1 to 21 represent by way of example one embodiment of a calendar system according to the invention, notably an annual calendar system.

One embodiment of a timepiece 120 according to the invention is described hereinafter with reference to FIG. 1. The timepiece may in particular be a wristwatch. It includes a movement 110, preferably a mechanical movement.

The embodiment of the movement 110 represented in FIG. 1 includes a timepiece calendar system 100, notably an annual calendar system.

The embodiment of the timepiece calendar system 100 represented in FIGS. 1 to 21 advantageously comprises:

a date mobile 1;
a first device 3 for indexing the position of the date mobile;
the second device 4 for indexing the position of the date mobile;
an element 70, 4*b* for activating and deactivating at least one of the first and second indexing devices.

The date indication mobile is for example a date indication disk or a date disk.

The indexing of the date mobile 1 by one or the other of the first and second indexing devices is preferably mutually exclusive. In other words, the date mobile 1 is indexed by one or the other of the first and second indexing devices depending on the status of the element for activating and deactivating at least one of the first and second indexing devices. To this end, the activation and deactivation element may be an element for mutually exclusive activation and deactivation of the first and second indexing devices. Thus, the timepiece calendar system includes means for deactivating one indexing device when the other indexing device is activated. The means for deactivating one indexing device may be a pin or a stud or any kind of banking.

The calendar is therefore adapted to recognize months comprising thirty days or months comprising fewer than thirty days and months comprising thirty-one days in order to produce an annual or perpetual calendar.

Figure 2:
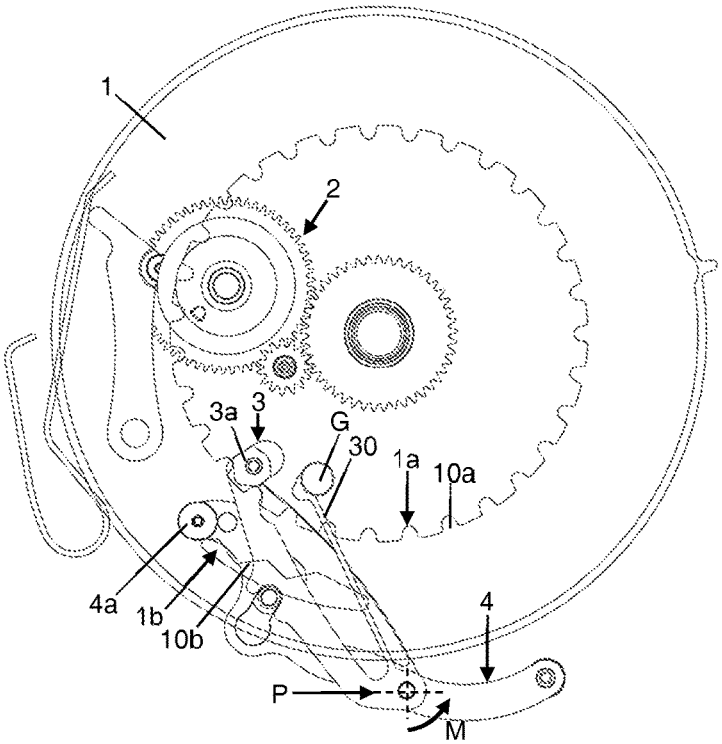
Figure 3:
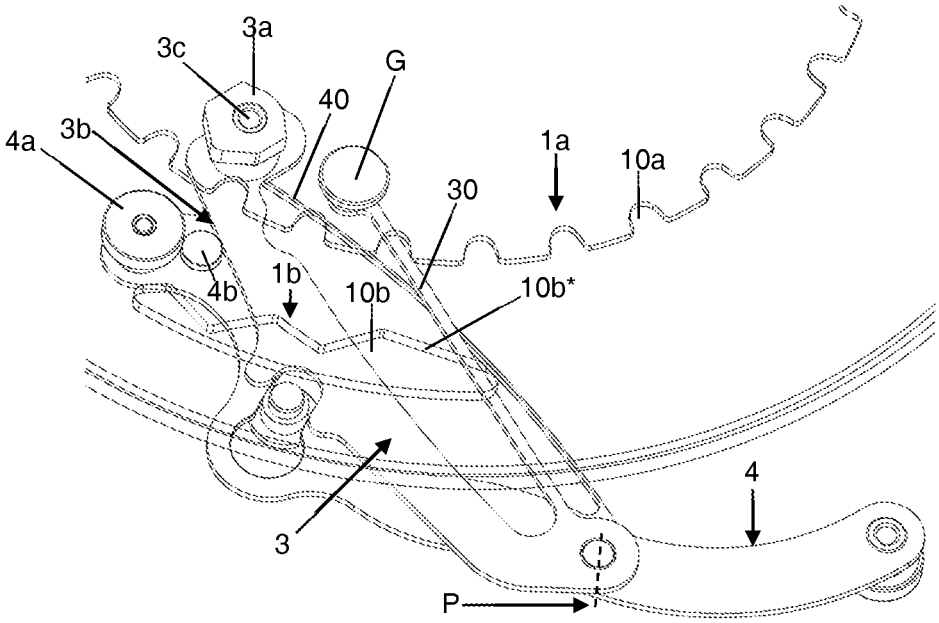

The calendar system 100 is therefore distinguished by the use of a date display disk 1 that can be positioned angularly or indexed either by the first indexing device 3 or by the second indexing device 4 of the date display disk, as represented in particular in FIGS. 1 and 2. As indicated above, the indexing of the date disk by one or the other of the first and second indexing devices is mutually exclusive. In other words, when the first indexing device 3 indexes the angular position of the date display disk 1 the second indexing device 4 does not index the angular position of the date display disk 1 and when the second indexing device 4 indexes the angular position of the date display disk the first indexing device 3 does not index the angular position of the date display disk 1.

The first indexing device advantageously includes a jumper 3, in particular a jumper head 3*a* and a return spring 30. The jumper 3, notably the head 3*a* of the jumper 3, is adapted to cooperate, notably to cooperate through contact, with a first toothset 1*a* of the date disk because of the effect of the return spring 30.

The second indexing device advantageously includes a lever 4 having a head 4*a*, notably a first roller 4*a*, and a return spring 40. The lever 4, notably the head 4*a*, may be adapted to cooperate, notably to cooperate through contact, with a second toothset 1*b* of the date disk. The second toothset 1*b* has a cam surface 10*b enabling the second indexing device, notably by way of the roller 4***a*, to drive the date disk over two steps of the date disk.

The disk 1 therefore has two separate toothsets 1*a*, 1*b*. The first toothset 1*a* comprises 31 teeth 10*a*. The teeth 10*a* are adapted to cooperate, notably to cooperate through mutual interference, on the one hand with an element 2 for driving the date disk and on the other hand with the jumper 3. The second toothset 1*b* includes at least one tooth, notably three teeth 10*b*, which for their part are specifically adapted to cooperate with the lever 4. The first indexing device, notably the jumper 3, and the second indexing device, notably the lever 4, are for example mobile in rotation, notably mobile in rotation about the same pivot axis P. The lever 4 is advantageously able to control the jumper 3 so as to inhibit its action on encountering the toothset 1*a* via means 3*b*, 3*c*, 4*b*, 40 described in more detail hereinafter with reference to FIG. 3.

In conventional or default operation of the calendar system, the angular position of the date display disk 1 is defined by the head or the beak 3*a* of the jumper 3, which is conformed to cooperate with two consecutive teeth 10*a*. To this end, the spring 30 of the jumper 3 takes the form of a spring arm 30 that is adapted to be armed by a pin G fastened to the frame of the movement so as to generate a resistive torque M about the axis P and therefore to enable the placing of the beak 3*a* against the teeth 10*a* when the disk 1 is not loaded by the drive element, as represented in FIGS. 1 and 2.

Figure 4:
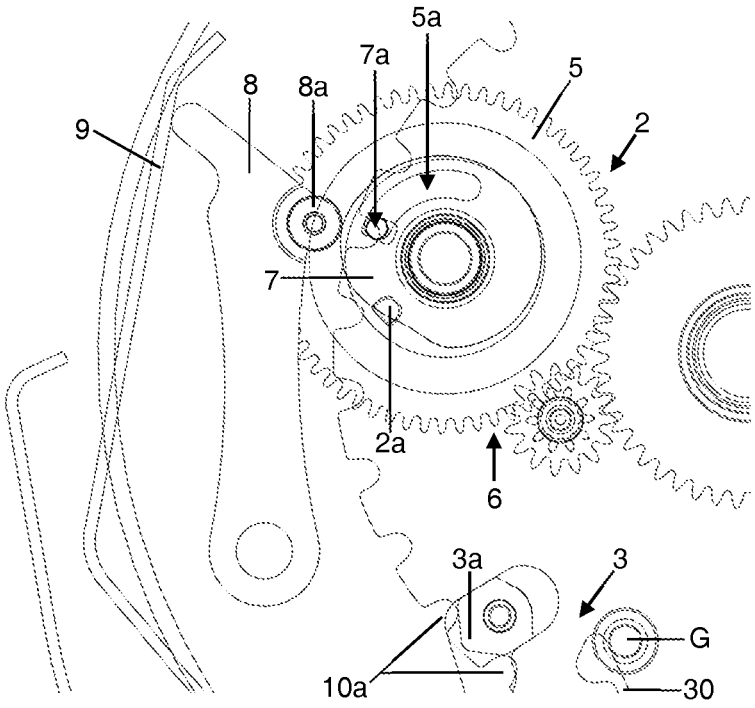

The drive element 2 may have an entirely conventional structure, as represented in FIG. 4. It includes a drive finger 2*a* that is adapted to drive a tooth 10*a* over an angular step of the date disk 1. It also includes a calendar wheel 5 effecting a complete rotation every 24 hours which is connected to the wheels 6 of the basic movement and a cam 7 which is adapted to cooperate with an energy accumulator 8, 8*a*, so that the drive finger 2*a* can drive the disk 1 instantaneously at the stroke of midnight. The accumulator includes a lever 8 having a roller 8*a*. A spring 9 is adapted to urge the lever 8 so that the roller 8*a* bears against the cam 7. The cam 7 is fastened to the drive finger 2*a*. The disengagement means between the wheel 5 and the cam 7 may be implemented by conventional means, such as for example an oblong cut-out 5*a* on the plate of the wheel 5, which is shaped to cooperate with a pin 7*a* driven into the cam 7. Alternatively, these disengaging means may be replaced by a clipping system such as that disclosed in the applicant's patent application EP2428855.

Figure 5:
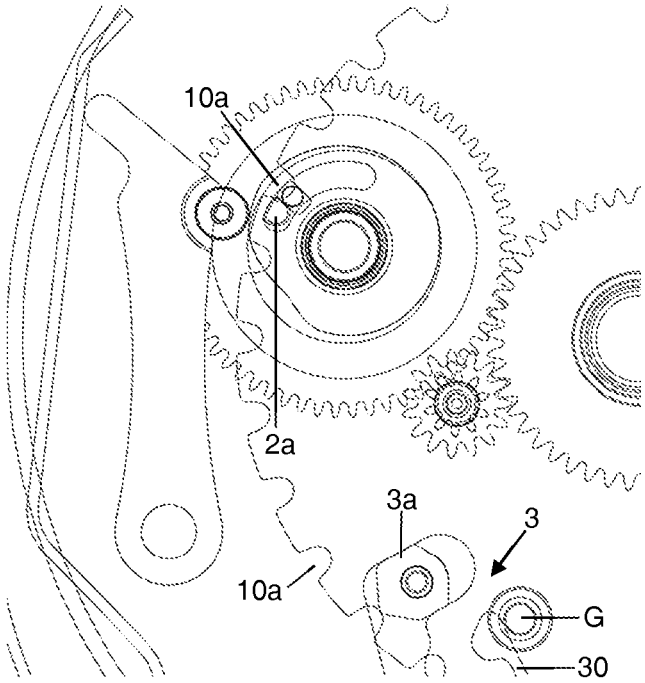
Figure 6:
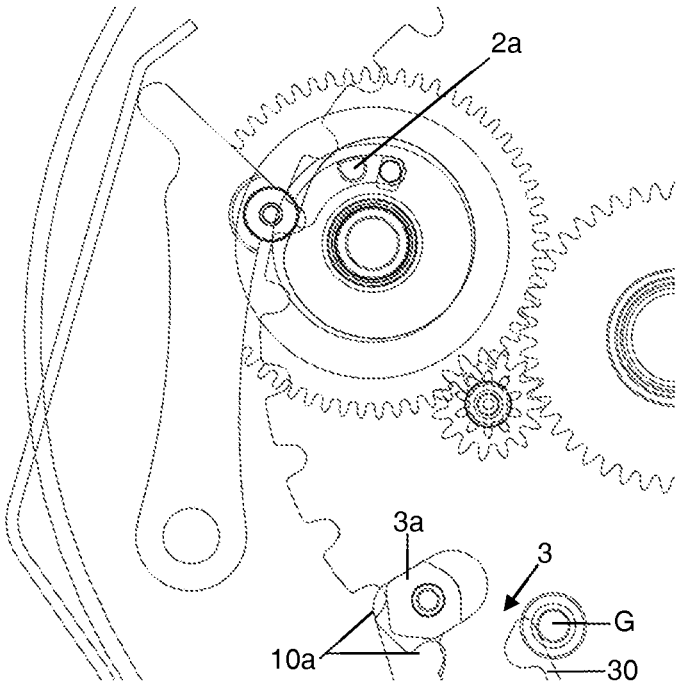

Throughout the day, the wheel 5 drives the cam 7 and accumulates the energy necessary for the finger 2*a* to jump instantaneously by arming the spring 9 via the profile of the cam 7 and the lever 8. Just before the date changes, the roller 8*a* reaches the summit of the profile of the cam 7. The change of date is effective in a fraction of a second when the spring 9 outputs the accumulated energy to communicate a sudden movement in rotation to the cam 7 and to the finger 2*a* via the lever 8 and its roller 8*a*. The finger 2*a* then overcomes the retaining torque M over at least one angular half-step of the disk 1 until the top 10*a* of the tooth has been passed at least by the beak 3*a*, as represented in FIG. 5. Having passed the top of the tooth, the spring arm 30 outputs the energy and repositions the disk 1 on the next day as represented in FIG. 6.

The lever 4 has no effect on the jumper 3 in conventional operation of the calendar mechanism, in particular at the end of a month comprising 31 days. Accordingly, the first indexing device is activated and the second indexing device is deactivated.

Figure 7:
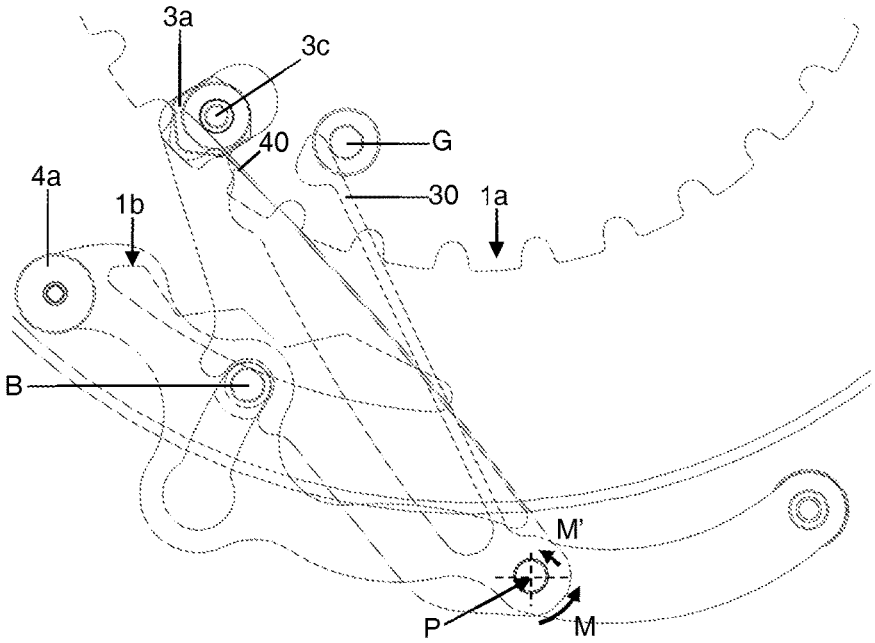

The spring 40, in the form of the spring arm 40, is prestressed by a pin 3*c* of the jumper 3, in particular the spacer 3*c* of the beak 3*a*, so as to generate a resistive torque M' about the axis P and therefore to enable unambiguous positioning of the lever 4 against a banking B that is fastened to the frame of the movement, as represented in FIG. 7. The spring arm 40 is such that the torque M' is significantly less than the torque M and therefore has no effect on the positioning and the movement of the beak 3*a* against the toothset 1*a*. For example, the torque M' may be ten times lower than the torque M.

In this configuration, the roller 4*a*, being disposed at a first end of the lever 4, is out of reach of the toothset 1*b*, as represented in FIG. 7. Accordingly, at the end of a month comprising thirty-one days, the date jump is effected conventionally as represented by FIGS. 4 to 6.

The activation and deactivation element preferably includes a first device 70, 3*b*, 4*b* for deactivating the first indexing device and a second device 40, 70 for activating the second indexing device. The first deactivating device 70, 3*b*, 4*b* is such that the first indexing device is deactivated and the second deactivation device 40, 70 is such that the second indexing device is activated when the date disk is driven to change from a short month to the next month.

The first deactivation device 70, 3*b*, 4*b* is preferably arranged such that the first indexing device is deactivated and the second activation device 70 is preferably arranged such that the second indexing device is activated during one day, or even two days, or even three days, preceding a change from a short month to the next month.

In addition to this or instead of this, the first deactivation device 70, 3*b*, 4*b* is arranged such that by default the first indexing device is activated and the second activation device 40, 70 is arranged such that the second indexing device is deactivated during the various months, notably during the days preceding a change from a long month to the next month with the exception of the days preceding a change from a short month to the next month.

The first device 70, 3*b*, 4*b* for deactivating the first indexing device may include a control cam 70. The first device 70, 3*b*, 4*b* for deactivating the first indexing device may include a first banking 3*b* on the first indexing device cooperating with a second banking 4*b* on the second indexing device so as to move the first indexing device away from its position cooperating with the date disk and so as to submit the second indexing device to the torque of the first return spring 30 of the first indexing device when the second indexing device is cooperating with the date disk.

By default the first indexing device is activated by the effect of the first spring 30. From then on, the first device for deactivating the first indexing device makes it possible to inhibit the cooperation of the jumper 3 and the date disk 1 because of the effect of the first spring 30.

The second device 40, 70 for activating the second indexing device may include a control cam 70. The second indexing device may be adapted to cooperate with the cam 70, notably via a second roller 4*c* on the lever 4. The second device for activating the second indexing device therefore makes it possible to constrain the second spring 40 so that the roller 4*a* is able to cooperate with the toothset 1*b*.

From then on, at the end of a month comprising 30 days, in particular on the change from the twenty-eighth day to the twenty-ninth day, the roller 4*a* on the lever 4 is positioned so that it can be actuated by a first tooth 10*b* of the toothset 1*b*. To this end, the lever 4 can be positioned by the annual cam 70 that is kinematically coupled to the date disk 1, for example via wheels 1*c*, 60, 70*c* as explained hereinafter with reference to FIG. 8. In this configuration, the roller 4*c*, being disposed at a second end of the lever 4, bears against the outside periphery 70*a* of the cam 70 because of the effect of the second spring 40.

Figure 8:
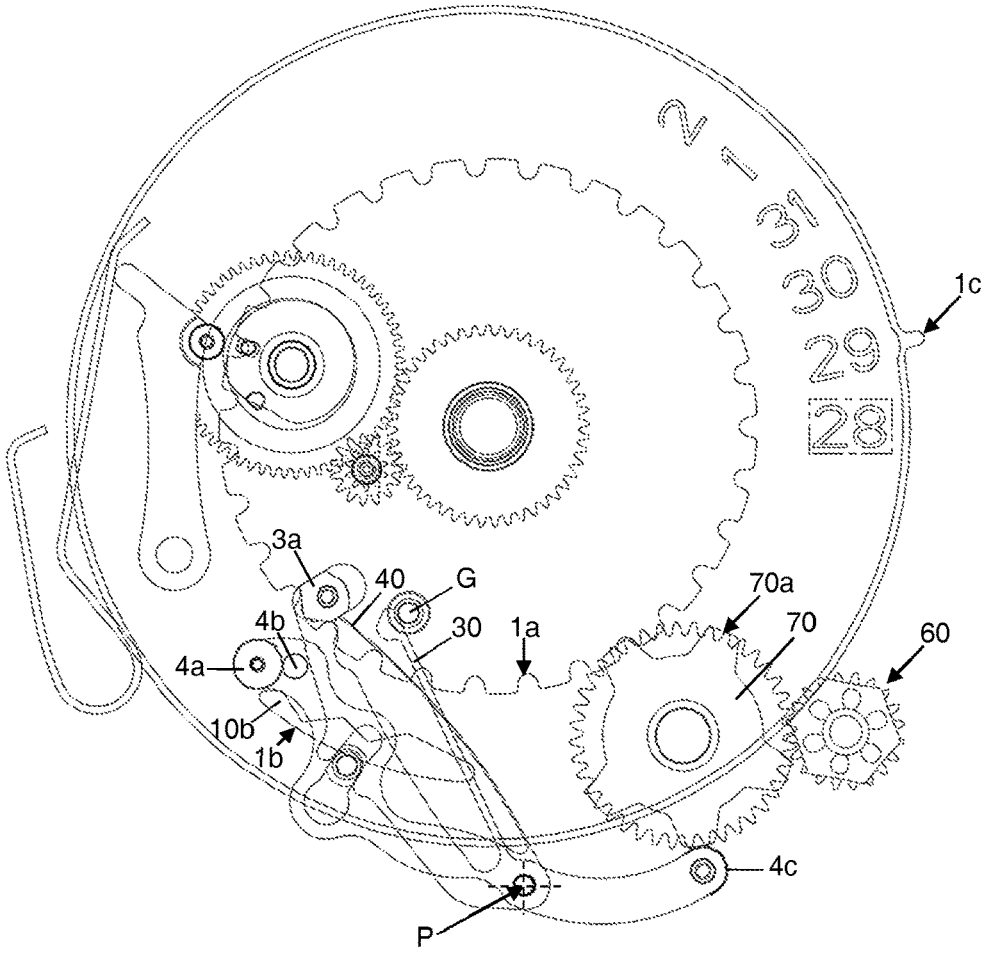

A date jump at the end of a short month or a month comprising thirty days, for example at the end of the month of April, is described hereinafter. FIG. 8 shows the annual calendar mechanism on 28 April, just before the date jumps from 28 to 29 April. In this configuration, the roller 4*a* on the lever 4 is positioned so that it can be actuated by a first tooth 10*b* of the toothset 1*b*.

Figure 9:
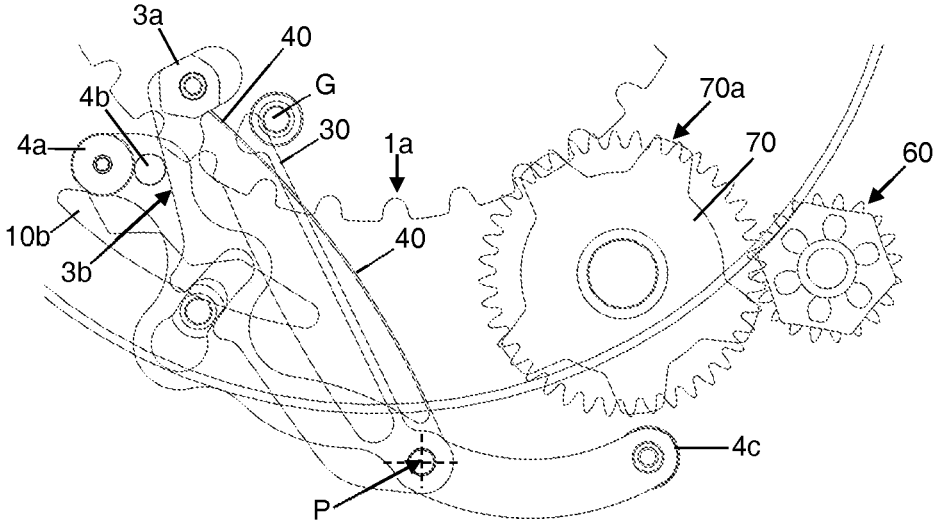
Figure 10:
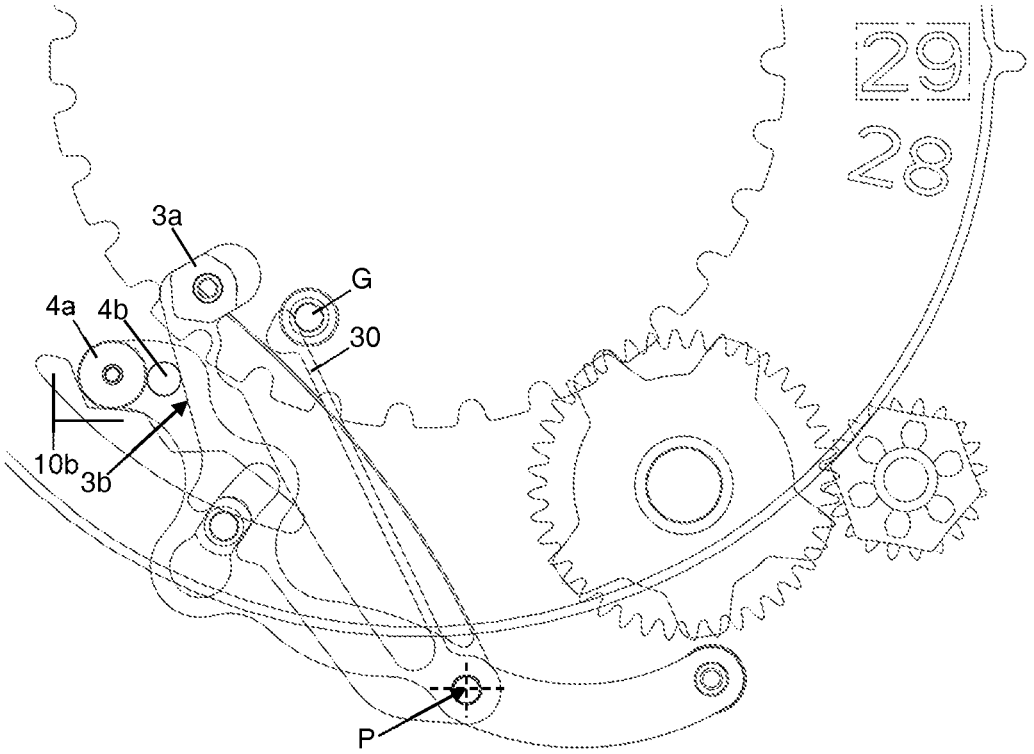

As represented in FIG. 9, when the date changes from 28 to 29 April a first tooth 10*b* acts on the roller 4*a*, which induces rotation of the lever 4 about the axis P. As it moves, the lever 4 actuates the jumper 3 via a pin 4*b* that is adapted to cooperate with a flank 3*b* of the jumper 3 so that the beak 3*a* is disengaged from the toothset 1*a*. Once the date jump has been effected, the angular position of the date display disk 1 is defined by the roller 4*a* of the lever 4, which is conformed to cooperate with two consecutive teeth 10*b*, as represented in FIG. 10.

The toothset 1*b* is such that, because of the lever 4, as the date changes from the twenty-eighth to the thirtieth the spring arm 30 accumulates the energy necessary to enable an additional jump of the disk 1 at the end of a short month. To be more specific, the toothset 1*b* is adapted to make possible complementary arming of the spring arm 30 at the same time as inhibiting the action of the beak 3*a* against the toothset 1*a*. The toothset 1*b* is preferably conformed so that the combination of the jumper 3 and the lever 4 generates a resisting torque about the axis P at least equal to M and thus to make possible adequate retention of the angular position of the date disk 1 when the latter is not loaded by the drive finger 2*a*. The energy required by the energy accumulator 8, 8*a*, 9 to enable a date jump when the toothset 1*b* is indexed by the roller 4*a* is advantageously not greater than that required to enable a date jump when the toothset 1*a* is indexed by the beak 3*a*. To this end, the geometry of the components, notably that of the toothset 1*b*, and the choice of materials are optimized to reduce losses caused by friction. For example, the roller 4*a* may take the form of a jewel 4*a* pivottably mounted at the end of the lever 4.

Figure 11:
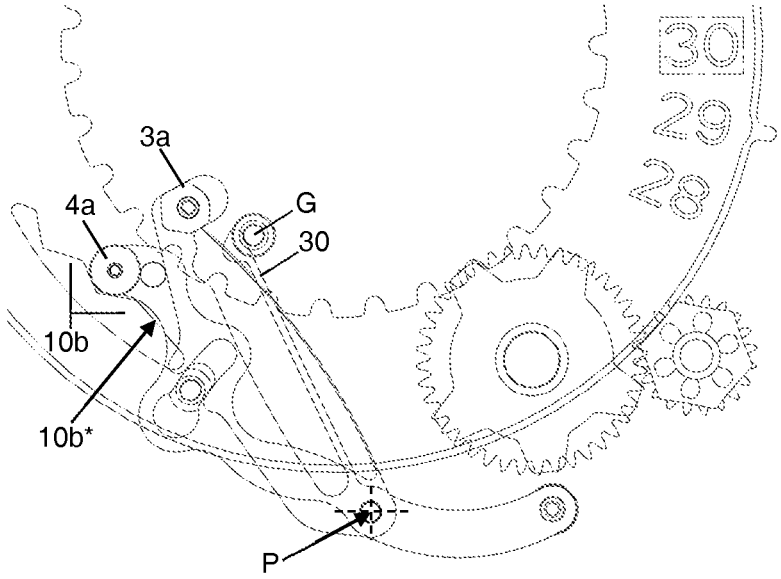

FIG. 11 shows the calendar mechanism on 30 April. In this configuration, the roller 4*a* of the lever 4 is pressed against the last two consecutive teeth 10*b* of the toothset 1*b*. The toothset 1*b* has the particular feature of terminating at a steep flank 10*b so that the lever 4 and its roller 4***a* can advance the date disk by an additional step, or two steps, because of the effect of the force output by the spring arm 30 of the jumper 3 acting on the lever via the pin 4*b*.

Figure 12:
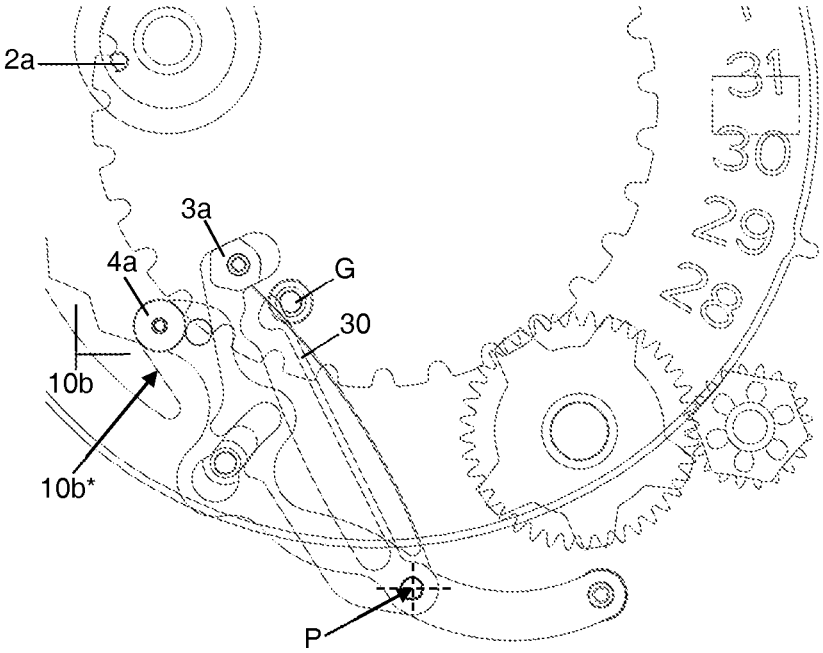
Figure 13:
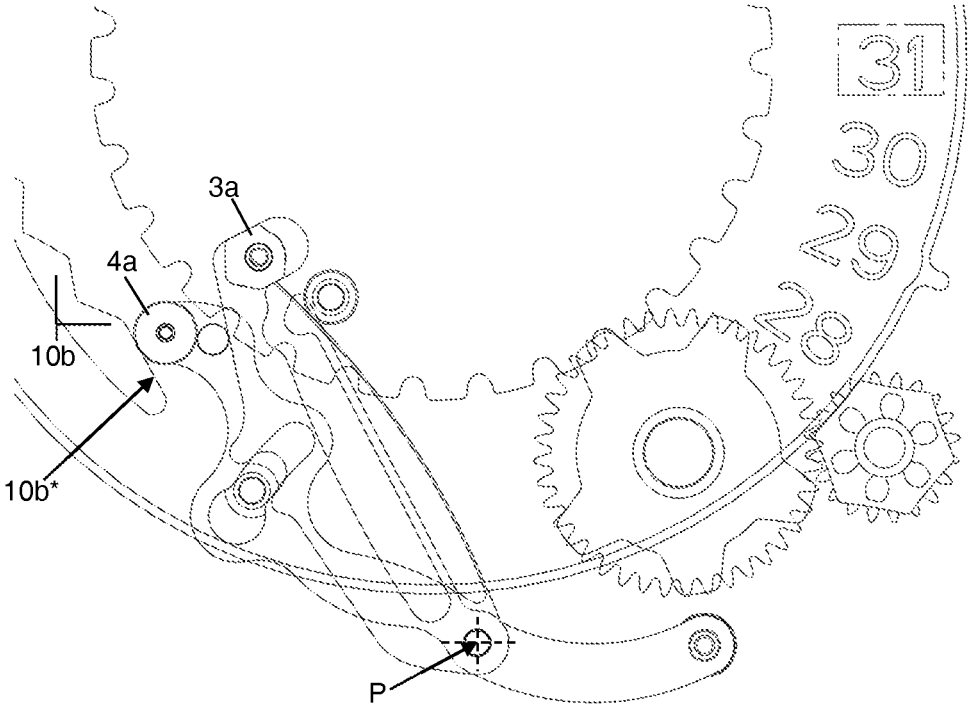
Figure 14:
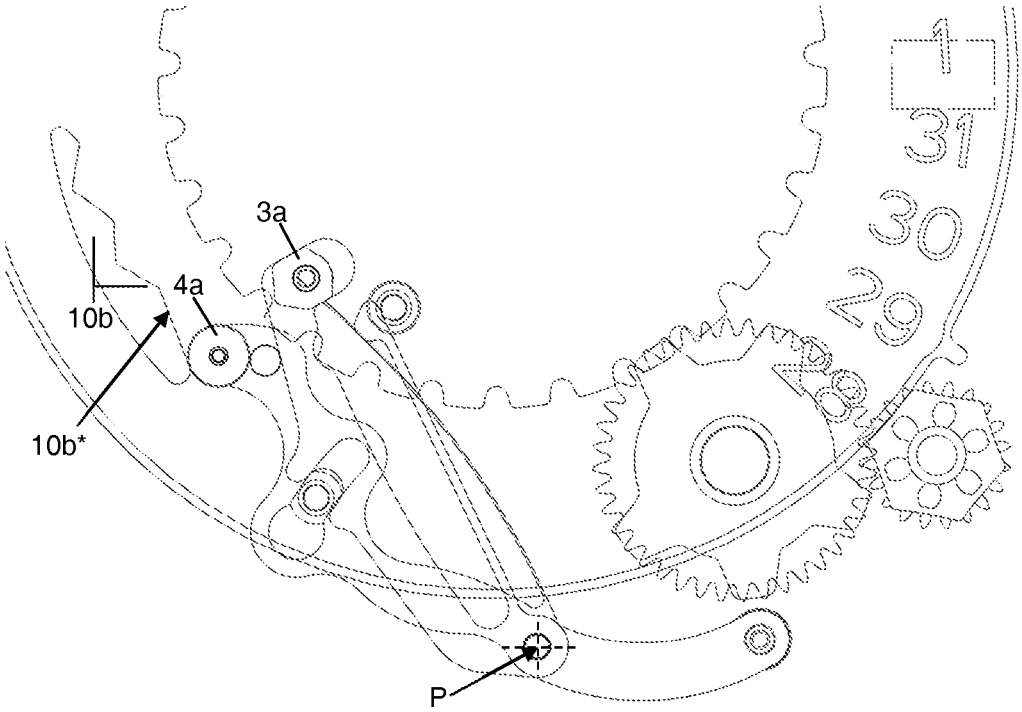

When the date changes from 30 April to 1 May, as represented in FIGS. 12 to 14, the drive finger 2*a* first drives the disk 1 over at least one angular half-step of the date disk until the top of the last tooth 10*b* has been passed at least by the roller 4*a*, as represented in FIG. 12. The additional date jump is effected in a second step by the cooperation of the roller 4*a* and the steep flank 10*b as represented in FIGS. 13 and 14 until the beak 3***a* is at least again in contact with the toothset 1*a* to make it possible to reposition the disk 1 on the next day, as represented in FIG. 15.

Figure 15:
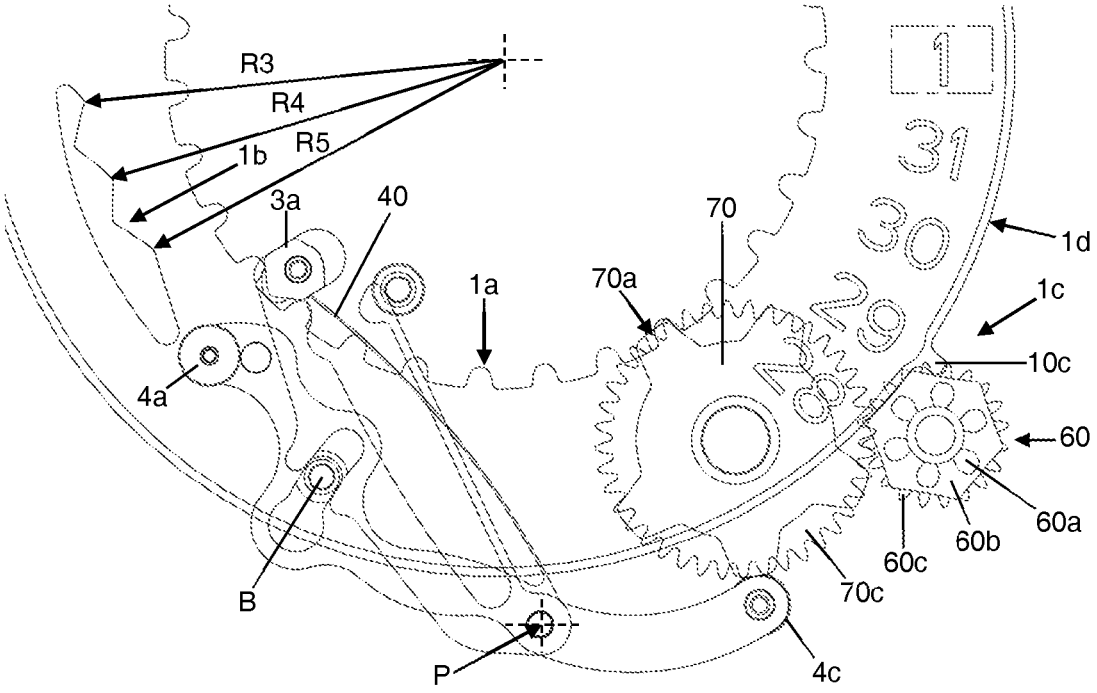
Figure 16:
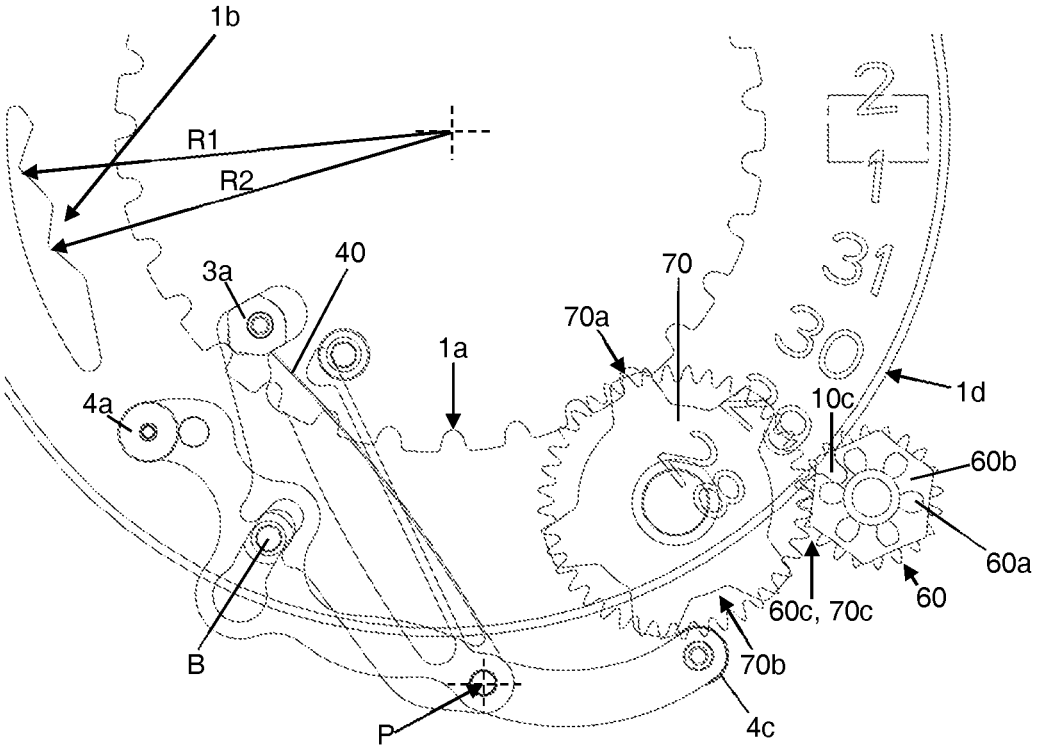
Figure 17:
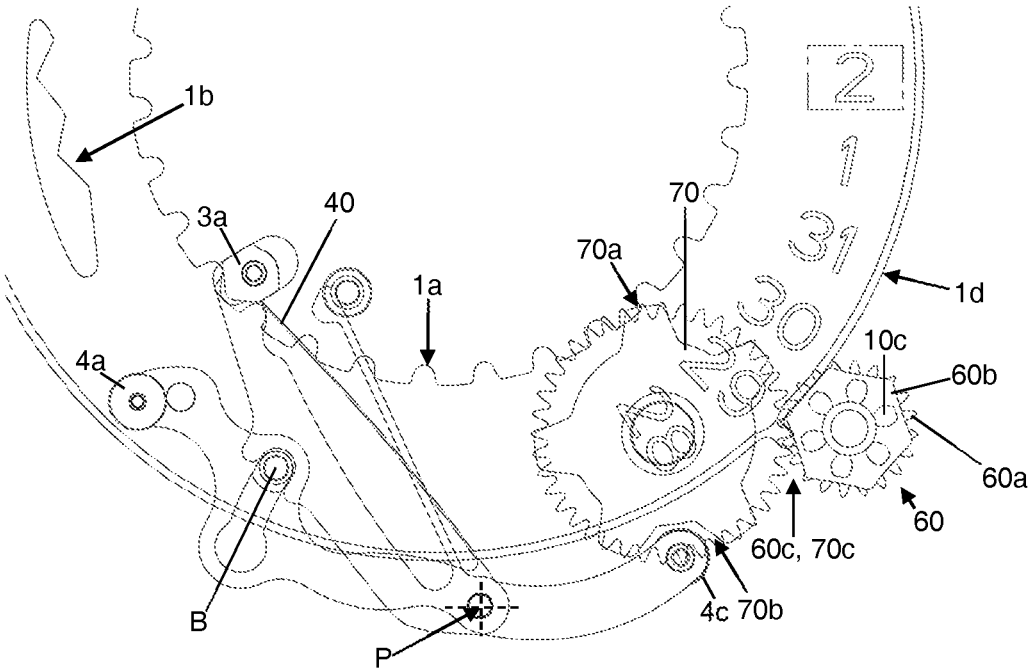
Figure 18:
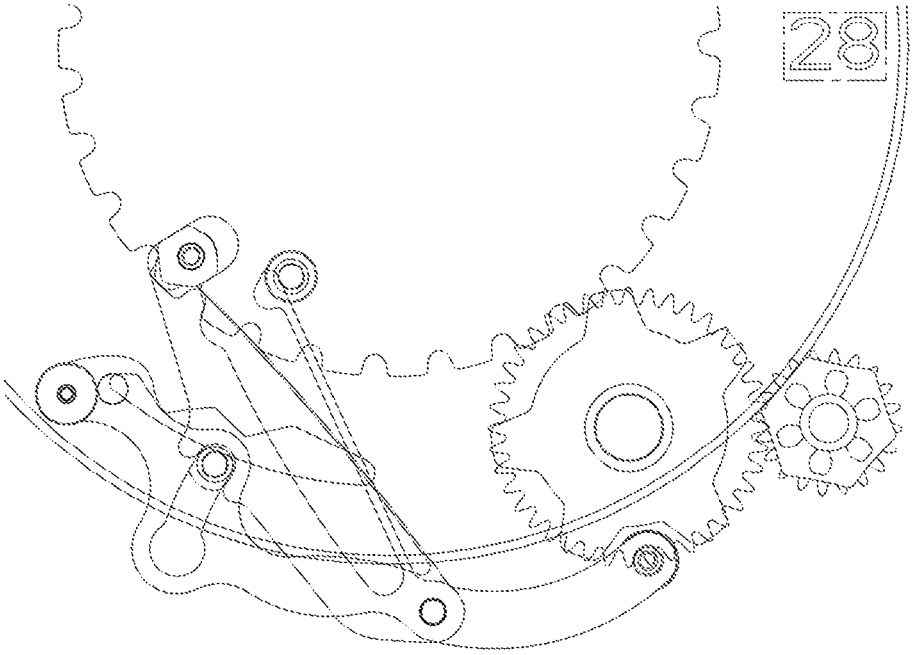
Figure 19:
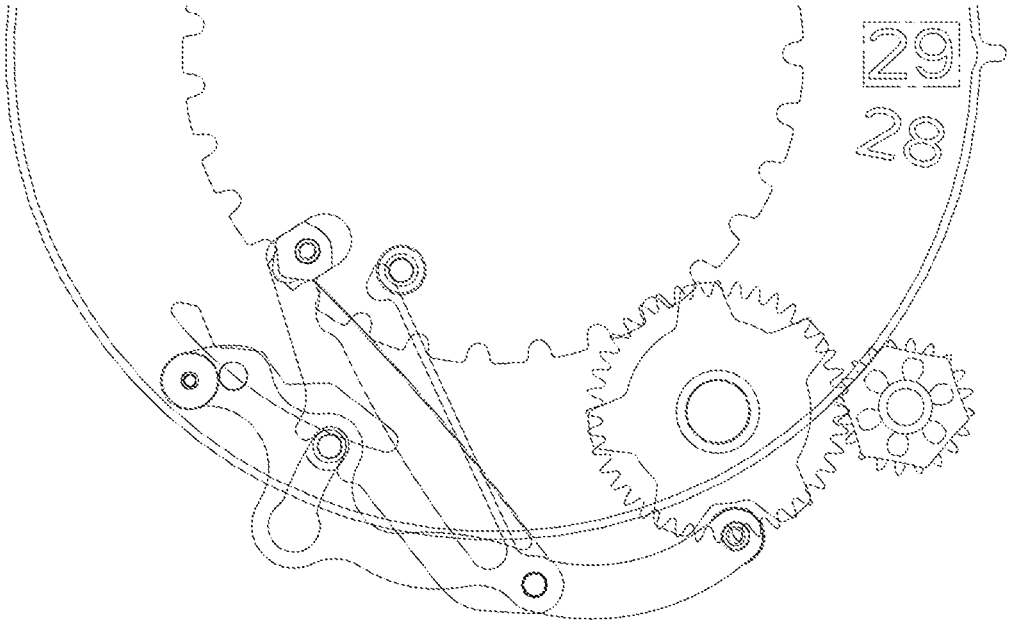
Figure 20:
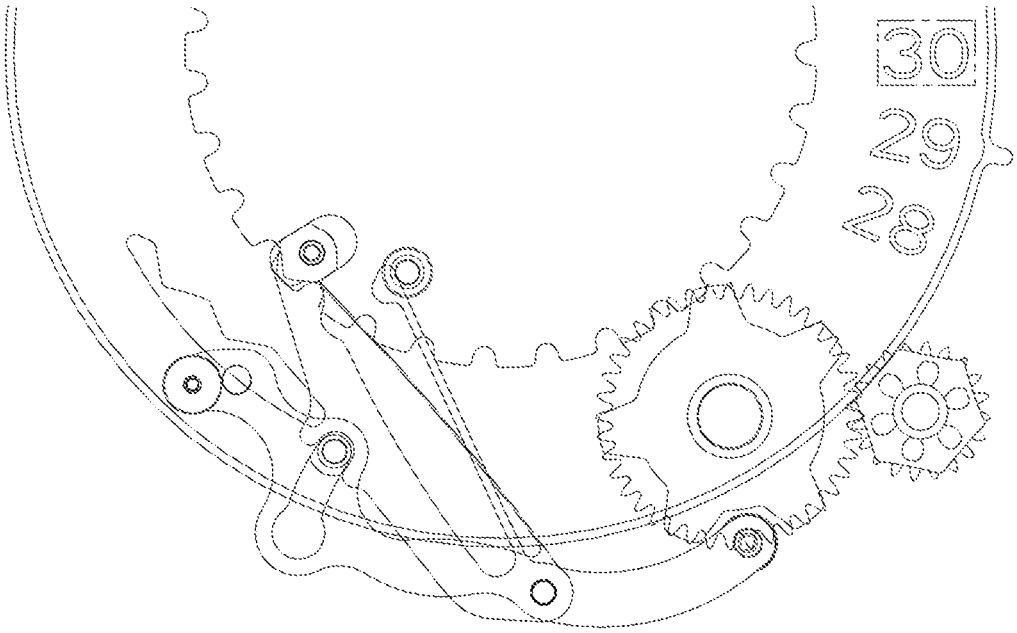
Figure 21:
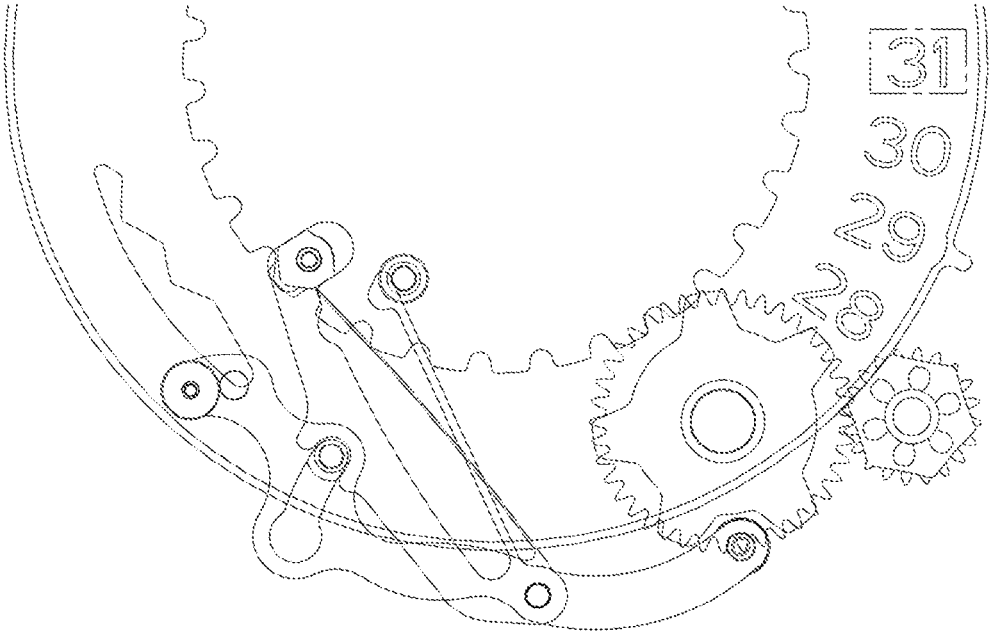

FIG. 15 shows the calendar mechanism on 1 May. In this configuration, the roller 4*a* is disengaged from the toothset 1*b* and in this embodiment the roller 4*c* continues to bear against the outside periphery 70*a* of the cam 70 because of the effect of the spring arm 40. This cam can be moved in rotation during the current month, for example on changing from the first day to the second day as represented in FIG. 16. To this end, the disk 1 has a third toothset 1*c* that here take the form of a single tooth 10*c* at the outside periphery of the disk 1. The latter tooth is adapted to cooperate with a setting wheel 60*a* of a mobile 60 that is kinematically coupled to the cam 70 via setting wheels 60*c*, 70*c*. In the default operation of the calendar mechanism, the angular position of the cam 70 is guaranteed, apart from the backlash of the teeth, by an outside periphery 1*d* of the disk 1 adapted to cooperate with an angular locking member 60*b* operating in accordance with the principle of a Maltese cross. A coupling of this kind is similar to that disclosed in the applicant's patent applications EP2428856 and EP2624075.

FIG. 16 shows the date jump on changing from 1 May to 2 May. The rotation of the cam 70 causes the lever 4 to move because of the effect of the force produced by its spring arm 40 until it encounters the banking B that is fastened to the frame of the movement. In this configuration, the roller 4*a* is out of reach of the toothset 1*b*, and this continues to be the case until the lever 4 is again moved by the periphery 70*a* of the cam 70. Accordingly, the lever 4 is inoperative at the end of a month comprising thirty-one days. Only the beak 3*a* of the jumper 3 is adapted to index the angular position of the date disk, which allows one and only one date jump. By way of example, FIGS. 18 to 21 show the calendar mechanism in the period from 28 May to 31 May.

In this embodiment, the toothset 1*b* is able to act on the lever 4 as soon as the change from the twenty-eighth day to the twenty-ninth day occurs. In other words, the energy necessary for the additional date jump is accumulated over three jumps of the date disk. To this end, note that the radius R1 of the circle centered on the rotation axis of the disk 1 and passing through the gap between the bottoms of the first two successive teeth 10 is greater than the radius R2 of the circle centered on the rotation axis of the disk 1 and passing through the gap between the bottoms of the last two successive teeth 10, as represented in FIG. 16. Likewise, note that the radius R3 of the circle centered on the rotation axis of the disk 1 and passing through the top of a first tooth 10 is greater than the radius R4 of the circle centered on the rotation axis of the disk 1 and passing through the top of a second tooth 10, which is itself greater than the radius R5 of the circle centered on the rotation axis of the disk 1 and passing through the top of a last tooth 10, as represented in FIG. 15. Of course, it is possible to conform the toothset 1*b* so as to accumulate energy over a different number of jumps of the date disk.

Accordingly, the first indexing device 3 is such that the date disk is moved by one step on each action of the drive element and the second indexing device 4 is such that the date disk is moved by two steps on each action of the drive element occurring at the end of the thirtieth day of a short month or a month comprising thirty days.

One mode of execution of a method according to the invention is described hereinafter. The method governs the operation of a calendar system as described above, for example, and therefore comprising:

a date disk 1;

a first device 3 for indexing the position of the date disk;

the second device 4 for indexing the position of the date disk;

an element for activating and deactivating at least one of the first and second indexing devices.

The method may equally govern the operation of a movement or a timepiece.

The method includes deactivating the first indexing device and activating the second indexing device for changes from the dates of a short month to the next month.

Accordingly, the first and second indexing devices are selectively activated on changes from a month end to the next month. These activations are preferably mutually exclusive, i.e. when one of the indexing devices is activated the other one is not. Accordingly, the date disk 1 is indexed by one or the other of the first and second indexing devices depending on the status of the element for activating and deactivating at least one of the first and second indexing devices.

The first indexing device is preferably activated by default, notably during and at the end of long months. On the other hand, the second indexing device is activated only at the end of short months, i.e. during the last day or the last few days preceding the end of a short month, notably the last two days or the last three days. In particular, the second indexing device is preferably activated on the last day or days of the months of February, April, June, September and November.

It must of course be understood that an indexing device is activated even during a transient phase of changing date once the indexing device is actually indexing the date disk in position at a first date on a first day and the indexing device is actually indexing in position the date disk at a second date on a second day, the second day coming just after the first day.

The calendar system described above has the major advantage of proposing a lever 4 that is adapted to make it possible to inhibit the jumper 3. There is therefore no resistive torque generated by the jumper 3 to be overcome at the moment of the additional date jump. Moreover, studies carried out by the applicant have shown that the energy required by the energy accumulator 8, 8*a*, 9 to enable a date jump when the toothset 1*b* is indexed by the roller 4*a* is not greater than that required to enable a date jump when the toothset 1*a* is indexed by the beak 3*a*. Accordingly, the annual calendar system described above has the same energy consumption as a simple calendar system.

In the embodiment of the system described above, the drive element 2 is of the instantaneous jump type. Alternatively, it could take the form of a semi-instantaneous jump or even drag type drive element. The energy accumulator 8, 8*a*, 9 could take the form of a spring adapted directly to actuate a drive finger against a tooth 10*a*.

In the embodiment of the system described above the disk 1 has interior toothsets 1*a*, 1*b*. Alternatively, the toothsets 1*a* and 1*b* may be exterior toothsets. In this alternative construction, the disk 1 may for example take the form of a wheel on which a pointer to display the date indication is mounted. Alternatively, the disk 1 may be adapted to actuate a mechanism for displaying a "large date".

In the embodiment of the system described above, the lever 4 is directly actuated by a cam 70. Of course, the lever 4 could be driven via an additional drive lever. The cam 70 may be adapted to display the month indication and possibly to constitute a month display member. In this embodiment, the cam 70 is actuated by the date disk 1 during the month. Of course, the cam 70 could be actuated on changing from the thirty-first to the first of the next month. To this end, the lever 4 or where applicable the drive lever could be actuated by an ancillary driver device. Alternatively, the month could be displayed by a device such as that disclosed by the patent applications EP2428856 and EP2624075 via a month display disk kinematically coupled to a date display disk, for example.

The embodiment of the calendar system described above thus uses a calendar drive lever which at the end of each month comprising thirty days operates in conjunction with a conventional calendar drive element of the instantaneous jump type. The lever of this embodiment differs in that it is also adapted to enable angular indexing of the date disk. A construction of this kind makes it possible to employ a totally instantaneous annual calendar device, the energy consumption of which is minimized. A perpetual calendar could equally be produced on the basis of a construction of this kind, for example via an additional drive element of the date disk.

In the embodiment described above, the drive lever of the date disk has the particular feature of acting on the date disk in a localized manner. In some configurations of the calendar system, it is also adapted to index the angular position of the date disk and therefore to take over from the conventional date jumper. The torque required to move the date disk by an additional step is preferably produced by the jumper for indexing the date disk. The torque to enable the movement of the drive lever is therefore not added to the torque necessary for indexing the date disk.

Moreover, the calendar drive element may be a similar size to a calendar drive element of a simple calendar, which is adapted to enable the date disk to jump over one and only one angular step. A construction of this kind is therefore particularly favorable in terms of energy and development.

The invention claimed is:

1. A timepiece calendar system comprising:

a date indication mobile;

a first indexing device for indexing the position of the date indication mobile, wherein, when the first indexing device is activated, the position of the date indication mobile is indexed by the first indexing device in each of at least two different positions indicating two successive calendar days, wherein the first indexing device comprises a first toothset having successive teeth cooperating with a first head to index the date indication mobile on successive calendar days;

a second indexing device for indexing the position of the date indication mobile, wherein, when the second indexing device is activated, the position of the date indication mobile is indexed by successive teeth of the second indexing device in at least two different positions indicating two successive calendar days, wherein the second indexing device comprises a second toothset having successive teeth cooperating with a second head to index the date indication mobile on successive calendar days, the second toothset being separate from the first toothset;

an activating and deactivating element for activating and deactivating at least one of the first and second indexing devices, wherein each the first and second indexing devices is activated and deactivated by activating and deactivating the cooperation of the respective first or second toothset and the respective first or second head to index the date indication mobile on successive calendar days, wherein the second indexing device is deactivated whenever the first indexing device is activated and the first indexing device is deactivated whenever the second indexing device is activated, so that the indexing of the date indication mobile by one or the other of the first and second indexing devices is mutually exclusive.

2. The system as claimed in claim 1, wherein the activation and deactivation element comprises:

a first deactivation device for deactivating the first indexing device; and a second activation device for activating the second indexing device, the first deactivation device being so that the first indexing device is deactivated and the second activating device being so that the second indexing device is activated when the date indication mobile is driven on passing from a short month to the next month.

3. The system as claimed in claim 2, wherein the first deactivation device and the second deactivation device are arranged so that (i) the first indexing device is deactivated and the second indexing device is activated during at least one day preceding the passage from any short month having less than 31 days to the next month, and (ii) the first indexing device is activated and the second indexing device is deactivated by default during all days of any long month and during all days of any short month other than the at least one day preceding the passage from the short month to the next month.

4. The system as claimed in claim 3, comprising an element for driving the date indication mobile, the first indexing device being so that the date indication mobile is moved one step on each action of the drive element and the second indexing device being so that the date indication mobile is moved by two steps on each action of the drive element occurring at the end of the thirtieth day of a short month.

5. The system as claimed in claim 2, comprising a drive element for driving the date indication mobile, the first indexing device being so that the date indication mobile is moved one step on each action of the drive element and the second indexing device being so that the date indication mobile is moved by two steps on each action of the drive element occurring at the end of the thirtieth day of a short month.

6. The system as claimed in claim 2, wherein at least one selected from the group consisting of (i) the first deactivation device for deactivating the first indexing device includes a control cam, and (ii) the second activation device for activating the second indexing device includes a control cam.

7. The system as claimed in claim 6, wherein the second activation device for activating the second indexing device includes a control cam, and the second indexing device is adapted to cooperate with the control cam.

8. The system as claimed in claim 2, wherein the first deactivation device for deactivating the first indexing device includes a first banking on the first indexing device cooperating with a second banking on the second indexing device so as to move the first indexing device away from a first position cooperating with the date indication mobile and to subject the second indexing device to a torque of a first return spring of the first indexing device when the second indexing device is cooperating with the date indication mobile.

9. The system as claimed in claim 2, wherein the first deactivation device is arranged so that the first indexing device is deactivated and the second activation device is arranged so that the second indexing device is activated during two days preceding the passage from a short month to the next month.

10. The system as claimed in claim 1, wherein the first indexing device includes a jumper and a first return spring.

11. The system as claimed in claim 10, wherein the jumper is adapted to cooperate with a first toothset of the date indication mobile because of the effect of the first return spring.

12. The system as claimed in claim 11, wherein the second indexing device includes a lever having a head, and a second return spring, wherein the lever is adapted to cooperate with a second toothset of the date indication mobile because of the effect of at least one selected from the group consisting of the first return spring and the second return spring.

13. The system as claimed in claim 12, wherein the second toothset has a cam surface enabling a roller to drive the date indication mobile over two steps of the date indication mobile.

14. The system as claimed in claim 1, wherein the second indexing device includes a lever having a head, and a second return spring.

15. The system as claimed in claim 1, wherein the first and second indexing devices are rotatable about the same axis and a return torque on the second indexing device about the axis is less than a return torque on the first indexing device about the axis.

16. The system as claimed in claim 1, wherein the system is of the instantaneous jump type.

17. A timepiece movement including a system as claimed in claim 1.

18. A timepiece including a system as claimed in claim 1.

19. The timepiece calendar system as claimed in claim 1, wherein the first indexing device comprises a jumper ca ring the first head acting on the first toothset of the date indication mobile under the effect of a first spring to index the date indication mobile;

wherein the second indexing device comprises a lever carrying the second head acting on the second toothset of the date indication mobile under the effect of a second spring to index the date indication mobile; and wherein the lever of the second indexing device is deactivated by inhibiting the action of the second head of the lever whenever the jumper of the first indexing device is activated and the jumper of the first indexing device is deactivated k inhibiting the action of the first head of the jumper whenever the second jumper of the second indexing device is activated, so that the indexing of the date indication mobile by one or the other of the first and second indexing devices is mutually exclusive.

20. A method of operating a timepiece calendar system comprising:

a date indication mobile;

a first indexing device for indexing the position of the date indication mobile, wherein, when the first indexing device is activated, the position of the date indication mobile is indexed by the first indexing device in at least two different positions indicating two successive calendar days, wherein the first indexing device comprises a first toothset having successive teeth cooperating with a first head to index the date indication mobile on successive calendar days;

the second indexing device for indexing the position of the date indication mobile, wherein, when the second indexing device is activated, the position of the date indication mobile is indexed by the second indexing device in at least two different positions indicating two successive calendar days, wherein the second indexing device comprises a second toothset having successive teeth cooperating with a second head to index the date indication mobile on successive calendar days, the second toothset being separate from the first toothset;

an activation and deactivation element for activating and deactivating at least one of the first and second indexing devices, wherein each the first and second indexing devices is activated and deactivated by activating and deactivating the cooperation of the respective first or second toothset and the respective first or second head to index the date indication mobile on successive calendar days, the method including:

deactivating the first indexing device and activating the second indexing device for the passage from dates of a short month to the next month.

21. The method of claim 20, wherein the method includes keeping the first indexing device active and keeping the second indexing device inactive for the passage from dates of a long month to the next month.

22. The method as claimed in claim 20, comprising (i) deactivating the first indexing device and activating the second indexing device during at least one day preceding the passage from any short month having less than 31 days to the next month, wherein (ii) the first indexing device is activated and the second indexing device is deactivated by default during all days of any long month and during all days of any short month other than the at least one day preceding the passage from the short month to the next month.

23. The method as claimed in claim 20, comprising driving the date indication mobile by one step when the first indexing device is activated and driving the date indication mobile by two steps at least once when the second indexing device is activated.

24. The method as claimed in claim 20, wherein the timepiece calendar system has a configuration wherein the second indexing device is deactivated whenever the first indexing device is activated and the first indexing device is deactivated whenever the second indexing device is activated, so that the indexing of the date indication mobile by one or the other of the first and second indexing devices is mutually exclusive.

25. The method as claimed in claim 20, wherein the first indexing device comprises a jumper carrying the first head acting on the first toothset of the date indication mobile under the effect of a first spring to index the date indication mobile;

wherein the second indexing device comprises a lever carrying the second head acting on the second toothset of the date indication mobile under the effect of a second spring to index the date indication mobile; and wherein the lever of the second indexing device is deactivated by inhibiting the action of the second head of the lever whenever the jumper of the first indexing device is activated and the jumper of the first indexing device is deactivated k inhibiting the action of the first head of the jumper whenever the second jumper of the second indexing device is activated, so that the indexing of the date indication mobile by one or the other of the first and second indexing devices is mutually exclusive.

* * * * *